United States Patent [19]

Kubota et al.

[11] Patent Number: 4,682,170

[45] Date of Patent: Jul. 21, 1987

[54] APPARATUS FOR COLLECTING TOLL

[75] Inventors: Mitsuru Kubota, Tokyo; Kozo Amita, Yokohama, both of Japan

[73] Assignee: Kabushiki Kaisha Toshiba, Kawasaki, Japan

[21] Appl. No.: 674,311

[22] Filed: Nov. 23, 1984

[30] Foreign Application Priority Data

Nov. 25, 1983 [JP] Japan ..... 58-220733

[51] Int. Cl.[4] ..... G07B 15/00; G08G 1/065; G08G 1/02

[52] U.S. Cl. ..... 340/928; 340/51; 235/384

[58] Field of Search ..... 340/51, 910, 917, 907, 340/928, 942; 364/464, 436, 437, 424; 235/33, 384, 29 R, 31 T, 31, 472, 475, 476, 61 S, 61 V; 346/40; 382/1

[56] References Cited

U.S. PATENT DOCUMENTS

| | | | |
|---|---|---|---|
| 2,672,393 | 3/1954 | Cooper | 340/928 |
| 2,753,113 | 7/1956 | Cooper | 235/384 |
| 3,104,367 | 9/1963 | Grant | 340/928 |
| 3,158,836 | 11/1964 | McCauley | 340/928 |
| 3,663,936 | 5/1972 | Boudouris et al. | 340/928 |
| 3,705,976 | 12/1972 | Platzman | 340/928 |
| 4,288,688 | 9/1981 | Kiyama et al. | 235/384 |
| 4,493,103 | 1/1985 | Yamashita et al. | 340/928 |

*Primary Examiner*—Donnie L. Crosland
*Assistant Examiner*—Brent A. Swarthout
*Attorney, Agent, or Firm*—Finnegan, Henderson, Farabow, Garrett & Dunner

[57] ABSTRACT

One or more gates are provided at entry and exit of a toll road or a toll parking lot and at least one of the gates is commonly used for the entry and exit. Vehicles entering into the gate are guided to the common gate by traffic lights. An entry unit is installed at the entry gate and an exit unit is installed at the exit gate. The exit unit calculates and displays a toll corresponding to the content of the ticket. On both sides of the common gate there is provided a ticket issue unit and a circuit for calculating and displaying the toll after reading the ticket.

1 Claim, 8 Drawing Figures

APPARATUS FOR COLLECTING TOLL

BACKGROUND OF THE INVENTION

This invention relates to a method and apparatus for collecting tolls utilized for toll roads and toll parking lots.

One example of a prior art toll collecting system will firstly be described with reference to FIG. 1 of the accompanying drawings.

The toll collecting system shown in FIG. 1 is installed at an interchange of a toll road, for example, provided with four gates, that is two entry gates 11 and 12 and two exit gates 51 and 52. More particularly, this system is utilized for four vehicle lanes, that is two entry lanes and two exit lanes corresponding to respective gates. The outline of this system will be described as follows.

Respective booths of the entry gates 11 and 12 are provided with ticket vendors 21 and 22 and traffic light controllers, not shown. When the lanes are open, traffic lights 31 and 32 are changed from red to green under the control of the traffic light controllers to permit entrance of vehicles, not shown. Then when vehicles enter the gates as shown by arrows Fl and F2, vehicle detectors 41 and 42 installed at the entry gates detect that the vehicles enter the gates and the class of the vehicles (a large car, a medium car and a small car, a motor bike, etc.). The ticket vendors 21 and 22 issue tickets after writing detected vehicle class information and other necessary items on predetermined portions of the tickets as shown in FIG. 2. The tickets thus issued are handed over to drivers through clerks in charge or automatic machines.

The ticket T shown in FIG. 2 takes the form of a magnetic card, and the vehicle class information and other necessary informations (date, interchange number or the like) are magnetically recorded on a hatched zone a of the ticket. At the same time, the recorded information is printed on a space above the zone a so that the drivers and clerks in charge can visually confirm the contents of the recorded informations.

Exit units 61 and 62 and traffic light controllers (not shown) are installed in each booth of the exit gates 51 and 52 so that when given vehicle lanes are open, traffic lights 33 and 34 are changed from red to green under the control of the traffic light controllers to permit the vehicles to exit. Then, when the vehicles exit from the exit gates 51 and 52 as shown by arrows F3 and F4, the clerks in charge in the booths collect tickets from the drivers of the vehicles and insert the collected tickets into exit units 61 and 62 and ticket readers, not shown. When inserted with the tickets, the exit units 61 and 62 read out the contents stored in the tickets to confirm whether the contents are normal or not. When the contents are normal, the exit units calculate the tolls according to the read out contents and display the calculated tolls on toll displayers 71 and 72. Then the clerks in charge collect the displayed tolls from the drivers. As shown, vehicle detectors 43 and 44 are installed at the exit gates 51 and 52, respectively, which generate exit vehicle detection information and vehicle class information. Various comparisons of the information at the entry gate and the exit gate and the information regarding vehicle classes are made. More particularly, a comparison is made between the information of the ticket T read by the exit units and vehicle class information according to which tolls have been actually collected.

Usually, in a toll road, the number of vehicles passing through the entry gate and the exit gate of an interchange is not always constant In many cases, the number of vehicles passing through the entry gate and the exit gate varies greatly depending upon time zones, districts, etc. In the entry and exit gates of toll vehicle parking lots the same phenomenon occurs.

Accordingly, in the toll collecting system described above, the number of vehicles passing though the entry and exit gates is not always constant so that in one situation two booths and lanes are necessary for the entry and exit gates, while in another situation, adequate administration and processing can be made for only one booth and one lane. Since the prior art toll collecting system was constructed to change the number of gates and lanes when the number of vehicles passing through the gate varies, it is necessary to prepare a number of gates and lanes commensurate with the peak number of vehicles which become surplus during off-peak time.

SUMMARY OF THE INVENTION

It is an object of this invention to provide a novel method and apparatus for collecting tolls capable of providing reasonable system administration commensurate with the variation in the number of vehicles and with minimum numbers of gates and vehicle lanes.

According to one aspect of this invention, there is provided a method of collecting tolls wherein tickets are issued for vehicles utilizing a toll road or a toll parking station at at least one entry gate and the tickets are confirmed at at least one exit gate for collecting the tolls, wherein at least one of the entry gate and one of the exit gate are used as a common gate to be selectively used as the entry gate or the exit gate and vehicles are selectively guided to the common gate to enter or exit from the common gate.

According to another aspect of this invention, there is provided apparatus for collecting tolls from vehicles comprising entry processing means installed on one side of a gate for issuing tickets for the vehicles entering the gate, exit processing means installed on the opposite side of the gate for confirming the tickets of the vehicles exiting from the gate, the exit processing means calculating the tolls corresponding to the contents of the tickets, and displaying calculated tolls, traffic light means for guiding to the gate either one of the vehicles entering and exiting from the gate, and setting means for presetting the direction of guidance of the vehicles effected by the traffic light means.

DESCRIPTION OF THE PREFERRED EMBODIMENTS

Figure 1:
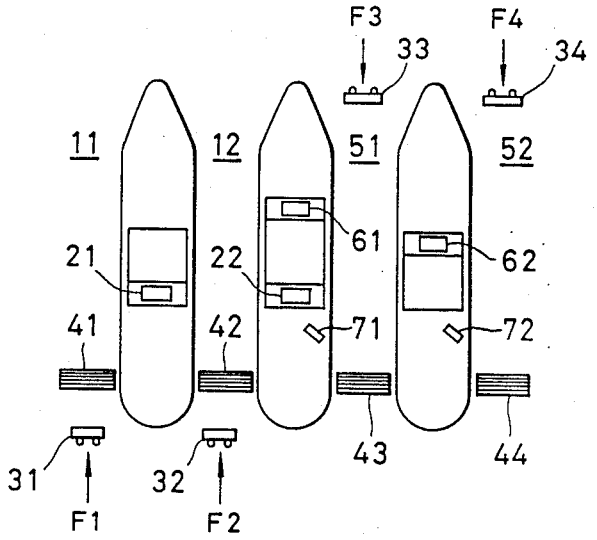
FIG. 1 PRIOR ART
FIG. 1 is a plan view showing a general arrangement of entry and exit gates utilizing a prior art toll collecting method.

A preferred embodiment of the system for collecting the tolls according to this invention will be described with reference to FIG. 3 which diagrammatically shows a toll collecting system adopted in an interchange of a toll road, for example, and various elements identical or similar to those shown in FIG. 1 are designated by the same reference numerals.

In this embodiment there are three gates, that is an entry gate 11, an exit gate 52 and a common gate 80 commonly used for the entry and exit and for executing various processings of collecting the tolls. The direction of pass of the vehicles through the common gate 80 is selected according to the direction of vehicles indicated by traffic lights 35 and lights 36 lighted in accordance with the number of vehicles passing through the entry and exit gates of the interchange so as to reduce the number of gates and the vehicle lanes. The system for collecting tolls with this embodiment will now be described in detail.

Booths B1 and B2 are installed on both sides of the common gate 80. The booth B1 is provided with an entry unit 21, an exit unit 92 and a toll display device 73, while the booth B2 is provided with an exit unit 62, an entry unit 91 and a toll display device 72. The entry unit 91, exit unit 92, and the toll display device 73 constitute the toll collecting apparatus of this invention (to be described later) together with traffic lights 35 and 36, a vehicle detector 45 and various apparatus (not shown in FIG. 3) which supervises and controls these elements. Although the construction and performance of the toll collecting apparatus will be described later in detail, for the sake of description, it is now assumed that the entry unit 91 operates in the same manner as the entry unit 21, that the exit unit 92 functions in the same manner as the exit unit 62, that the display device 73 functions in the same manner as the display device 72 and that the vehicle detector 45 operates in the same manner as the vehicle detector 41 or 44.

Figure 2:
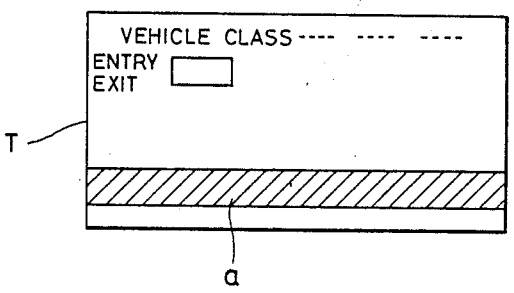
FIG. 2 is a plan view showing one example of a ticket.

It is further assumed that at the interchange the entry lane is congested with vehicles while the exit lane is not at this time, the clerk in charge executes a traffic light control through traffic light control means, not shown, such that traffic lights 35 and 34 become green while traffic light 36 becomes red. As a consequence, at the entry gate vehicles are permitted to enter two lanes through gates 11 and 80. On the other hand, at the exit vehicles are permitted to exit only through one lane, that is, through the gate 52. At the entrance, when vehicles enter gates 11 and 80 as shown by arrows F1 and F5, vehicle detectors 41 and 45 installed at these gates detect entrance of the vehicles and the classes thereof, while the entry units 21 and 91 write on the predetermined portions of the tickets (see FIG. 2) the detected vehicle class information and other necessary items and then issue the printed tickets. These issued tickets are handed over to the drivers by the clerks or automatic machines.

When a vehicle enters gate 52 as shown by arrow F4, a clerk in charge in the booth B2 collects ticket T from the driver and inserts the ticket into the exit unit 62 which reads out the content of the ticket to check whether the content is normal or not in the same manner as above described. When the content, is normal the toll is calculated based on the content, and then the calculated toll is displayed on the display device 72. Thereafter the clerk collects the displayed toll from the driver. Then the vehicle detector 44 detects that the paid vehicle has gone out and the class of the vehicle to send detected information to a processing apparatus, not shown, which executes desired comparison of the received information.

Suppose now that the entry of the interchange is not congested with vehicles but the exit is relatively congested. Then the clerk effects a control through traffic light control means such that traffic lights 31, 34 and 36 are green and the traffic light 35 is changed to red. Consequently at the entry, vehicles are permitted to pass along a single lane passing through the gate 11, while at the exit, vehicles are permitted to pass through two lanes through gates 80 and 52. When a vehicle enters gate 11 at the entry as shown by arrow F1, the vehicle detector 41 installed at that gate detects the entered vehicle and the class thereof in the same manner as above described, and also the entry unit 21 issues a ticket T, which is suitably handed over to a driver. When vehicles enter the gates 80 and 52 as shown by arrows F6 and F4 the clerks in booths B1 and B2 collect the tickets from the drivers and insert the collected tickets into exit units 92 and 62 respectively, which read out the contents of the inserted tickets so as to check whether the contents are normal or not. When the contents are normal, the tolls are calculated based on the read out contents, and the calculated tolls are displayed on the toll display devices 73 and 72 respectively. Then the clerks collect the displayed tolls from the drivers. After that, the vehicle detectors 45 and 44 detect the paid vehicles and the classes thereof and transmit information thus detected to processing apparatus, not shown, which execute necessary comparison in the same manner as above described.

As above described, according to the system of collecting the tolls of this invention, with a minimum number of gates and lanes it is possible to reasonably receive the tolls suitable for the number of vehicles.

Where both entry and exit of an interchange are not congested with vehicles, the traffic lights 35 and 36 are changed to red so as to pass vehicles by using only the entry gate 11 and the exit gate 52.

One example of the systems for collecting tolls will be described with reference to FIG. 4.

Figure 3:
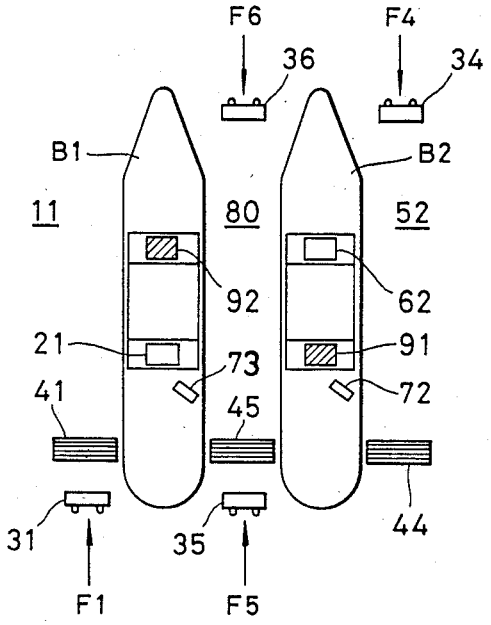
FIG. 3 is a diagrammatic plan view showing gates embodying one example of the system for collecting the tolls according to this invention.

The entry unit 91, the exit unit 92, traffic lights 35 and 36, the vehicle detector 45 and the toll display device 73 are arranged at respective gates and booths of the interchange as shown in FIG. 3. A setting switch 100 is installed in a booth or in an administration office of the interchange for setting the common gate 80 to be used as an entry gate or an exit gate. The setting switch 100 is operated by an operator with such mechanical transfer switch as a key switch, a toggle switch, a slide switch or a seesaw switch for sending out a signal corresponding to the set content to a central processing unit (CPU) 110. The CPU performs an overall control of various units and machines described above in accordance with the set signal sent from the setting switch 100 and processes as desired the necessary information. Traffic light control units 121 and 122 control ON and OFF of the traffic lights 35 and 36 in response to an instruction from the CPU. There are also provided a vehicle detection interface 130 which transfers a vehicle detection signal and vehicle class information detected by a vehicle detector 45 to the CPU, and a toll display interface 140 which transfers to the toll display device 73 toll information calculated by the CPU in accordance with read out information of the ticket confirmed by the exit unit 92.

Figure 5A:
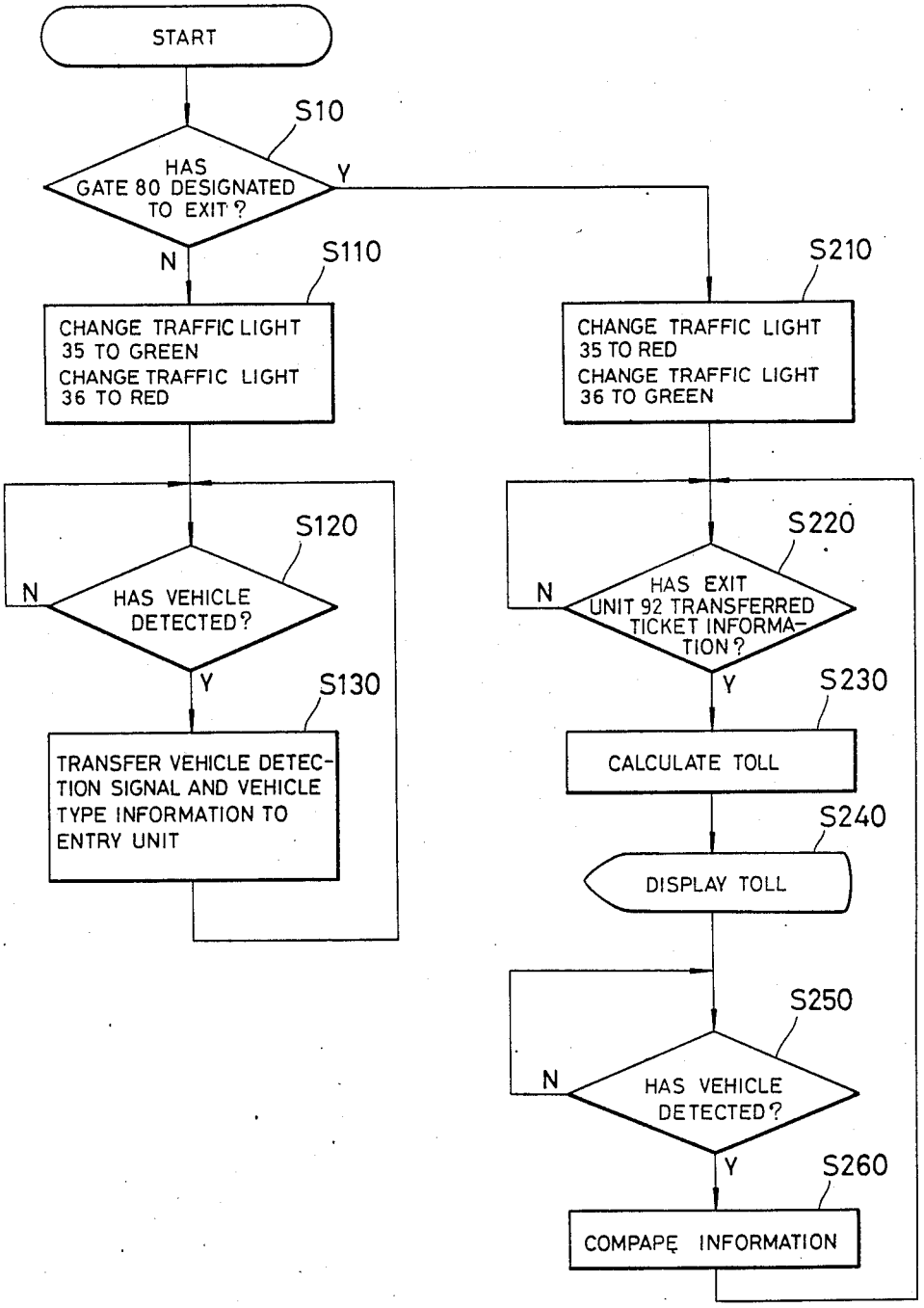
FIGS. 5A, 5B and 5C are flow charts for explaining the operation of the apparatus shown in FIG. 4.
Figure 5B:
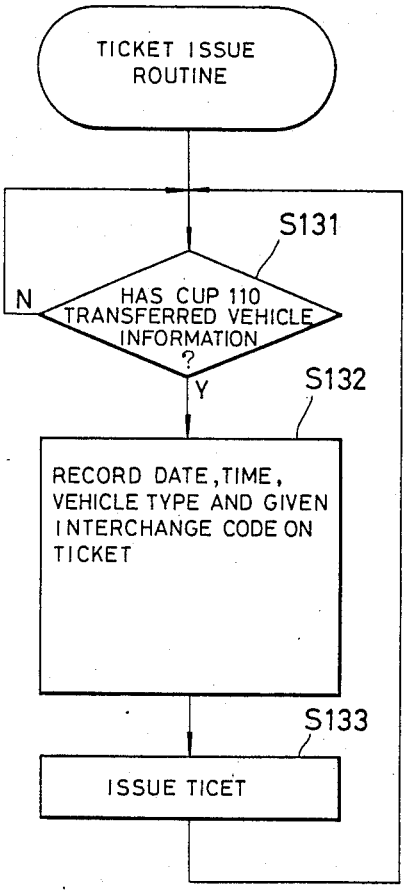
Figure 5C:
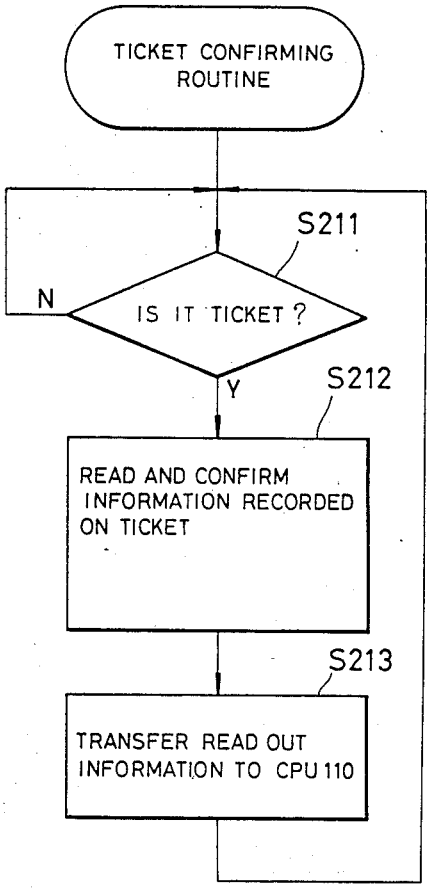

The operation of this apparatus will be described in detail with the aid of flow charts shown in FIGS. 5A, 5B and 5C in which FIG. 5A shows a flow chart showing the operation of the CPU, FIG. 5B shows a flow chart showing the operation of the entry unit 91, and FIG. 5C is a flow chart showing the operation of the exit unit.

When the operator sets the common gate 80 (see FIG. 3) to act as an entry gate through the setting switch 100, at step S10, the CPU 110 judges this state. At step S110 an instruction is sent to the traffic light control units 121 and 122 to change the traffic light 35 to green and traffic light 36 to red, thereby permitting the vehicles to enter in a direction shown by arrow F5 (see FIG. 3). After that, when a vehicle enters the gate 80, the vehicle detector 45 detects the entrance of the vehicle and the class thereof. When the vehicle is detected at step S120, at step S130 a vehicle detection signal and vehicle class information are transferred to the entry unit 91 at step S130. Each time the vehicle detection signal and the vehicle class information are transferred from the CPU 110, at step S131, the entry unit records on the ticket T shown in FIG. 2, the date, time information, an interchange code identifying a specific interchange, etc., based on the vehicle detection signal at step S132 and issues the recorded ticket T at step S133. S130 by the CPU 110 and the processings executed at steps S131–S133 by the entry unit 91 are repeatedly done each time the vehicle detector 45 detects the entrance of a vehicle. The tickets thus issued are sequentially handed over to respective drivers. Of course, a fully automatic entry unit can also be used.

When the operator sets the common gate 80 to act as an exit gate through the setting switch 100, at step S10 the CPU judges this fact and sends an instruction to traffic light control units 121 and 122 to change the traffic light 35 to red and change the traffic light 36 to green at step S210 shown in FIG. 5A. As a consequence, vehicles are permitted to exit in the direction of arrow F6 (see FIG. 3). As an exiting vehicle advances to the clerk in the booth B1 (see FIG. 3) the clerk collects the ticket T from the driver and inserts the ticket in the ticket reader (not shown) of the exit unit 92. Consequently, at step S211 shown in FIG. 5C, the exit unit 92 judges that the ticket T has been inserted to read the information recorded in the ticket T and confirms whether the read out content is normal or not at step S212 shown in FIG. 5C.

When the content is normal, the read out information is sent to the CPU 110 at step S213 shown in FIG. 5C. When the result of judgment shows that the recorded information is abnormal, an alarm device or display device, not shown, is operated to inform this fact to the clerk so as to cause him to execute necessary processing. Each time ticket information is sent from the exit unit 92, the CPU 110 judges this information at step S220 shown in FIG. 5A to calculate a toll based on the ticket information at step S230 shown in FIG. 5A. In addition, the CPU 110 displays the calculated toll on the toll display device 73 through the toll display interface 140 at step S240 shown in FIG. 5A. Then, the clerk collects the displayed toll from the driver.

After that, when the paid vehicle exits the gate 80 the vehicle detector 45 detects the exiting vehicle and the class thereof. When the exit of the vehicle is detected, the CPU 110 judges this fact at step S250 shown in FIG. 5A to receive the vehicle detection signal and the vehicle information so as to compare them with the ticket information of the vehicle transmitted from the exit unit 92 at step S260 shown in FIG. 5A. As a consequence, a judgment is made as to whether a processing regarding the collection of a toll was executed normally or not. The processings at steps S211–S213 of the exit unit 92, and the steps S220–S260 of the CPU 110 are repeatedly executed each time the clerk inserts a ticket T into the exit unit 92.

By the operation described above, the common gate 80 is effectively used as either an entry gate or an exit gate so that the system for collecting the toll of this invention can be effectively carried out.

Figure 4:
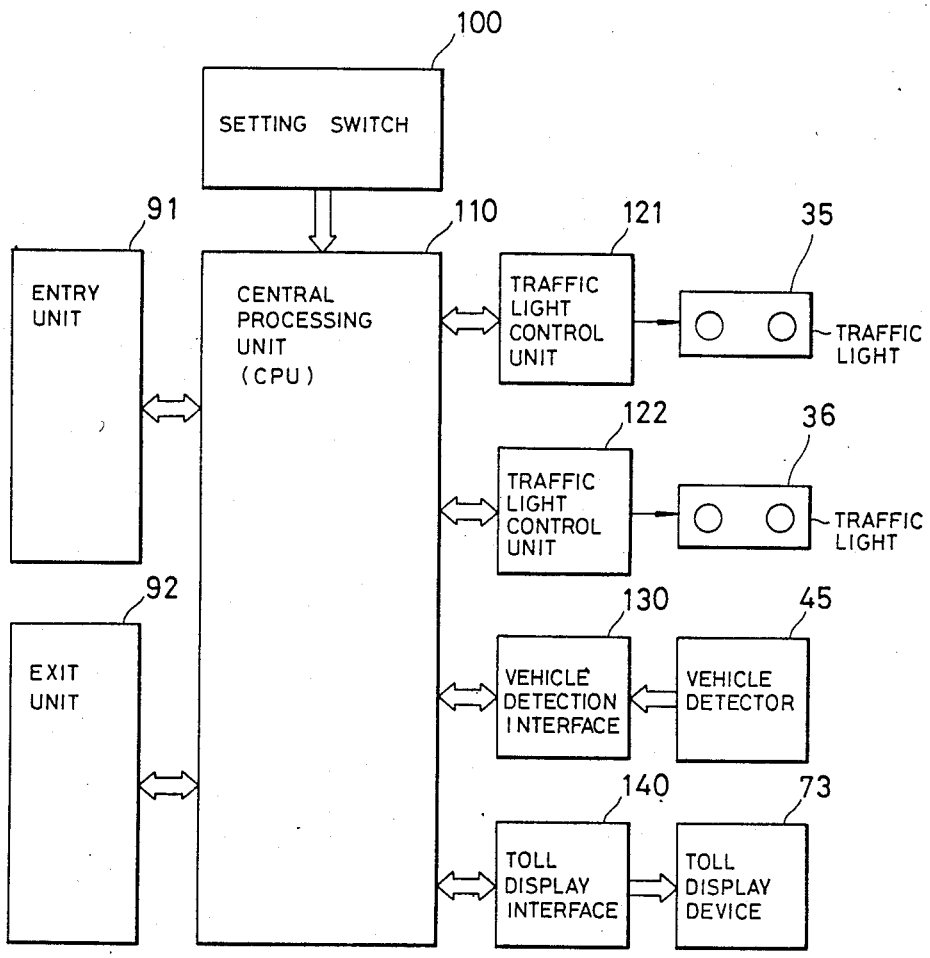
FIG. 4 is a block diagram showing one embodiment of the apparatus for collecting the tolls according to this invention.

In the apparatus shown in FIG. 4, the CPU 110 calculates the tolls, but where a calculating performance is added to the exit unit 92, that unit can directly calculate the toll.

Figure 6:
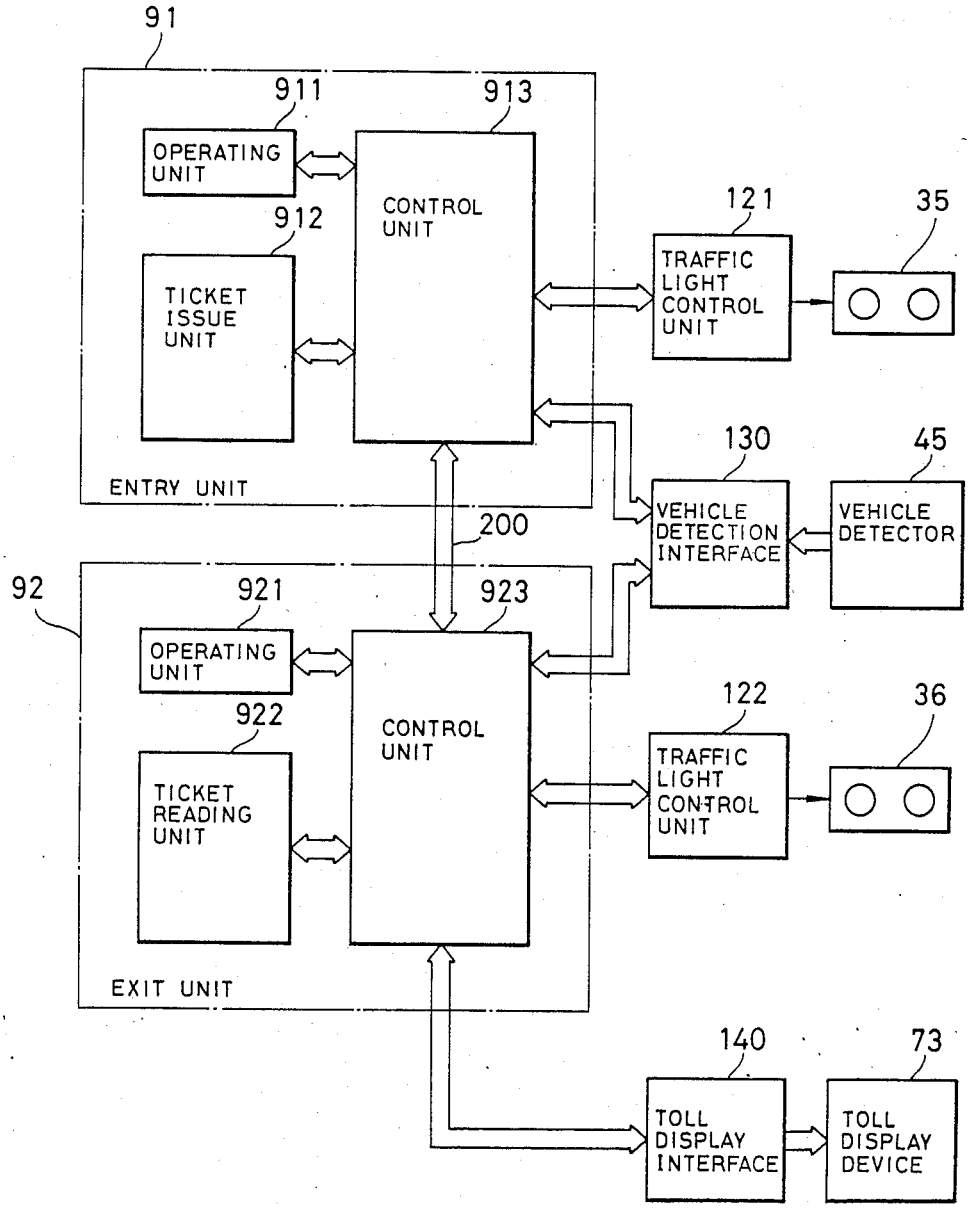
FIG. 6 is a block diagram showing another embodiment of the toll collecting apparatus according to this invention.

FIG. 6 shows a modified embodiment of the toll collecting apparatus according to this invention.

Although in the apparatus shown in FIG. 4, overall control of the entry unit 91, the exit unit 92 and peripheral apparatus is executed by the setting switch 100 and the CPU 110 installed in the booth or in the supervisory office of an interchange, in the modification shown in FIG. 6, means that can accomplish the control and processings executed by the setting switch 100 and the CPU 110 are added to each of the entry unit 91 and the CPU 110.

The modification shown in FIG. 6 will now be described in detail. In FIG. 6 elements identical or similar to those shown in FIGS. 3 and 4 are designated by the same reference numerals.

The entry unit 91 shown in FIG. 6 comprises an operation as operating unit 911 including suitable information inputting setting means such as a transfer switch described above, a ticket issue unit 912 of the type described above, and a control unit 913 which controls the ON and OFF of the traffic lights in accordance with the state of the operation of the operating unit 911, as well as the issuance of the ticket and execute processings of signals. In the same manner, the exit unit 92 comprises as operating unit 921 including suitable information inputting and setting means, a ticket reading unit 922 and a control unit 923 which controls ON and OFF of the traffic lights in accordance with the operating state of the operating unit 921 as well as confirmation of the tickets and executes processings of signals. The entry unit and the exit unit are installed in the booths on the opposite sides of the common gate as shown in FIG. 3.

The two control units 913 and 923 are electrically interconnected by an electric wire 200 so as to supervise each other (that is whether they are in operating states or not). When either one of the entry unit 91 and the exit unit 92 is in the operating state, the other unit is made inoperative through the control units. This can be done in various manners. For example, the operating unit on the side rendered inoperative can be automatically locked or the control unit can be made not to respond to the operation of the control unit. In any way, this can be accomplished with conventional techniques.

The vehicle detector 45 and the vehicle detection interface 130 are commonly connected to the control units 913 and 923 so as to furnish the data detected by the detector 45 to either one of the control units. As above described, the entry unit 91 and the exit unit 92 are selectively used and the detected data is selectively supplied to either one of the control units which is actually used.

Assume now that the clerk in the booth B2 (see FIG. 3) operates the operating unit 911 for rendering operative the entry unit 91 in the booth B2 for the purpose of using the common gate 80 as an entry gate when the exit unit 92 is in an inoperative state. Then the control unit 913 of the entry unit 91 judges this state and changes the traffic light 35 to green through the traffic light control unit 121. Further the control unit 913 connects the vehicle detection interface 130 to itself and informs the fact that the entry unit 91 has been set to the operative state to the control unit 923 of the exit unit 92. Consequently, the control unit 923 renders inoperative the exit unit 92 without locking the operating unit 921 and changes the traffic light 36 to red through the traffic light control unit 122. In this manner, the common gate 80 is utilized as an entry gate so that the entry unit 91 issues tickets to the vehicles entering the gate 80. The succeeding operation of this modification is identifical to that of the previous embodiment that has been described by referring to the flow charts shown in FIGS. 5A-5C.

Suppose now that the clerk in the booth B1 (see FIG. 3) renders inoperative the entry unit 91 for the purpose of utilizing the common gate 80 as an exit gate, or that when the exit unit 92 in the booth B1 is rendered operative by the control unit 921 when the entry unit is not yet used. Then the control unit 923 of the exit unit 92 judges this fact and changes the traffic light 36 to green through the traffic light control unit 122. Further, the CPU connects the vehicle detection interface 130 to its control unit and informs the fact that the exit unit 92 has been set to the operative state to the control unit 913 of the entry unit 91 through the wire 200. As a consequence, the control unit 913 of the entry unit 91 is rendered inoperative in the same manner as above described while at the same time the traffic light 35 is changed to red via the traffic light control unit 121. In this manner, the conditions for utilizing the common gate 80 as the exit gate are satisfied. Thereafter, the exit unit 92 confirms the tickets of the vehicles passing through the gate 80 and integrates the collected tolls. Succeeding operations of this embodiment are similar to those of the foregoing embodiments.

In this embodiment too, the common gate 80 is used as an entry gate or exit gate so that the system of receiving the tolls according to this invention can be carried out.

In this embodiment when both of the entry unit 91 and the exit unit 92 are not used, the control units 913 and 923 of these units turn traffic light 35 and 36 to red.

It should be understood that the invention is not limited to specific embodiments described above and that many changes and modifications will be obvious to one skilled in the art without departing from the true spirit and scope of the invention as defined in the appended claims. For example, the common gate is not limited to one and where the number of the common gates is increased large variation in the number of vehicles can be efficiently handled.

What is claimed is:

1. A apparatus for collecting toll from vehicles using a toll facility such as a toll road or a toll parking lot wherein tickets carrying data necessary for control are issued for the vehicles at one or a plurality of entry gates and the data on the tickets are read and identified at one or a plurality of exit gates, said apparatus comprising:

entry processing means installed at one end of an entry/exit common gate which is chosen from at least one of said entry gates and said exit gates and functions as both an entry gate and an exit gate for issuing said tickets;

exit processing means installed at another end of said entry/exit common gate for identifying said tickets;

first traffic signal means, disposed at said entry/exit common gate, for informing operators of vehicles entering said toll facility as to whether entry to said entry/exit common gate is permitted or not;

second traffic signal means, disposed at said entry/exit common gate, for informing operators of vehicles exiting said toll facility as to whether entry to said entry/exit common gate is permitted or not;

setting means for setting whether said entry/exit common gate is used as an entry gate or an exit gate; and control means for causing said entry processing means to be in its operative state and said exit processing means to be in its inoperative state and for causing said first traffic signal means to indicate that entry into said toll facility through said entry/exit common gate is permitted and said second traffic signal means to indicate that exit from said toll facility through said entry/exit common gate is not permitted when said setting means is set so that said entry/exit common gate is used as an entry gate; and for causing said entry processing means to be in its inoperative state and said exit processing means to be in its operative state and for causing said first traffic signal means to indicate that entry into said toll facility through said entry/exit common gate is not permitted and said second traffic signal means to indicate that exit from said toll facility through said entry/exit common gate is permitted when said setting means is set so that said entry/exit common gate is used as an exit gate, further comprising vehicle detecting means, electrically connected to said control means and disposed at said entry/exit common gate, for detecting a vehicle passing through said vehicle entry/exit common gate and class of the passed vehicle wherein said control means transfers information supplied from said vehicle detecting means to said entry processing means when said setting means is set so that said entry/exit common gate is used as an entry gate and said control means transfers said information to said exit processing means when said setting means is set so that said entry/exit common gate is used as an exit gate;

said entry processing means writes data indicative of data, time, class of vehicles, and gate number necessary for control and issues said ticket on which said data is written based on the transfer of said information produced by said vehicle detecting means; and said exit processing means performs identification between the class of vehicle written on said ticket and information on the class of vehicle exiting said toll facility detected by said vehicle detecting means on the transfer of said information.

* * * * *